US008316778B2

(12) United States Patent
Smith et al.

(10) Patent No.: US 8,316,778 B2
(45) Date of Patent: Nov. 27, 2012

(54) TABLE WITH STOWAWAY UMBRELLA

(76) Inventors: Dale M. Smith, Napoleon, OH (US); Diana M. Smith, Napoleon, OH (US)

( * ) Notice: Subject to any disclaimer, the term of this patent is extended or adjusted under 35 U.S.C. 154(b) by 722 days.

(21) Appl. No.: 12/270,464

(22) Filed: Nov. 13, 2008

(65) Prior Publication Data

US 2009/0165681 A1 Jul. 2, 2009

Related U.S. Application Data

(63) Continuation-in-part of application No. 29/302,652, filed on Jan. 22, 2008, now Pat. No. Des. 608,120.

(60) Provisional application No. 61/017,276, filed on Dec. 28, 2007.

(51) Int. Cl.
*A47B 37/04* (2006.01)

(52) U.S. Cl. ..... 108/50.12; 135/16

(58) Field of Classification Search .... 108/50.11–50.13, 108/25, 86, 147.11, 147.19; 135/96, 16, 135/46

See application file for complete search history.

(56) References Cited

U.S. PATENT DOCUMENTS 1,250,292 A * 12/1917 Erickson ..... 135/25.31
1,809,474 A * 6/1931 Dos Santos ..... 135/75
1,885,968 A * 11/1932 Wedemann ..... 135/25.41
2,183,833 A * 12/1939 Farhar ..... 135/20.3
2,190,498 A * 2/1940 Williams ..... 312/243
2,838,351 A * 6/1958 Siconolfi et al. ..... 108/25
2,883,247 A * 4/1959 Thompson ..... 248/156
3,479,973 A * 11/1969 Bartlett et al. ..... 108/141
3,709,238 A * 1/1973 Leopoldi et al. ..... 135/15.1
3,844,301 A * 10/1974 Harrell ..... 135/15.1
3,851,657 A * 12/1974 Weber ..... 135/25.4
3,935,874 A * 2/1976 Cohen ..... 135/16
4,132,236 A * 1/1979 Petersen et al. ..... 135/16
4,805,541 A * 2/1989 Drane et al. ..... 108/27
5,110,375 A * 5/1992 Parsons ..... 148/534
5,188,137 A * 2/1993 Simonelli ..... 135/19.5
5,335,803 A * 8/1994 O'Brien et al. ..... 211/163
5,353,716 A * 10/1994 Wilbert ..... 108/150
5,690,131 A * 11/1997 Voigt ..... 135/19.5
6,523,485 B1 * 2/2003 Cipolla ..... 108/14
6,766,814 B2 * 7/2004 Perreault ..... 135/31
D608,120 S * 1/2010 Smith et al. ..... D6/486
2006/0151018 A1 * 7/2006 Wilson ..... 135/16
2006/0272555 A1 * 12/2006 Carter ..... 108/50.12

* cited by examiner

*Primary Examiner* — Darnell Jayne
*Assistant Examiner* — Timothy M Ayres
(74) *Attorney, Agent, or Firm* — Fraser Clemens Martin & Miller LLC; J. Douglas Miller

(57) ABSTRACT

A table including a collapsible umbrella and a hollow main body is provided. The hollow main body is adapted to receive the umbrella when the umbrella is in a collapsed position. The collapsible umbrella may include a pole coupled to a plurality of hinged ribs supporting a canopy. Each of the ribs may include a first hinge coupled to the pole that facilitates a downward folding of the umbrella, and a second hinge disposed between a first end of the rib and a second end of the rib that facilitates an upward folding of a portion of the umbrella. A method for storing the umbrella of the table is also provided.

19 Claims, 5 Drawing Sheets

TABLE WITH STOWAWAY UMBRELLA

CROSS-REFERENCE TO RELATED APPLICATION

This application claims the benefit of U.S. Provisional Application No. 61/017,276, filed on Dec. 28, 2007, and U.S. Design application Ser. No. 29/302,652, filed on Jan. 22, 2008. The entire disclosures of the above applications are hereby incorporated herein by reference.

FIELD OF THE INVENTION

The present invention relates to patio furniture and, in particular, a patio table having a collapsible and stowable umbrella.

BACKGROUND OF THE INVENTION

It is known to have furniture that is specially made for use on porches, patios, and decks of homes, restaurants, and bars. In particular, a patio table and a set of chairs specifically for use on the deck are well known. The patio table often will have an umbrella that can be raised and lowered. The umbrella is generally located on a pole that is disposed in a hole in the center of the table and held in place by a weighted base. Other features such as a fan and lights are also known to be used with the patio table, for example, to allow the patio table to be used during the evening hours, to provide a cool breeze, and to repel insects.

Typically, the umbrella of the patio table may be removed through the hole in the center of the table and placed in storage. However, the umbrella can be unwieldy and difficult to remove. Due to the size of the umbrella, the umbrella may also have to be stored in a location different from the location of the table. The difficulty in removing and storing the umbrella can be particularly problematic under poor weather conditions such as during a strong wind.

There is a continuing need for a table that militates against the hassle of removing an outdoor umbrella and transporting the umbrella to and from storage. Desirably, the table also facilitates a rapid storage of the umbrella should a strong wind or another undesirable condition present itself.

SUMMARY OF THE INVENTION

In concordance with the instant disclosure, a table that militates against the hassle of carrying an outdoor umbrella to and from storage when not in use, and that facilitates a rapid storage of the umbrella, is surprisingly discovered.

In one embodiment, a table includes a collapsible umbrella and a hollow main body. The hollow main body is adapted to receive the umbrella when the umbrella is in a collapsed position.

In another embodiment, the table has a substantially planar surface with an aperture formed therein. The collapsible umbrella further includes a pole coupled to a plurality of hinged ribs supporting a canopy. Each of the ribs includes a first hinge coupled to the pole that facilitates a downward folding of the umbrella. Each of the ribs also includes a second hinge disposed between a first end of the rib and a second end of the rib that facilitates an upward folding of a portion of the umbrella. The pole is coupled to a plunger adapted to be received by the hollow main body. The plunger has an outer diameter that closely and slidably conforms to the inner diameter of the hollow main body, whereby the pole is rigidly held in an upright position. The hollow main body is adapted to receive the umbrella when the umbrella is in the collapsed position. The hollow main body is further disposed through the aperture formed in the table.

In a further embodiment, a method for storing the collapsible umbrella of the table includes the steps of: providing the table having the collapsible umbrella and a hollow main body adapted to receive the umbrella when the umbrella is in the collapsed position; folding the umbrella into the collapsed position; and disposing the umbrella in the hollow main body.

DRAWINGS

The above, as well as other advantages of the present disclosure, will become readily apparent to those skilled in the art from the following detailed description, particularly when considered in the light of the drawings described hereafter.

DETAILED DESCRIPTION OF THE INVENTION

Figure 1:
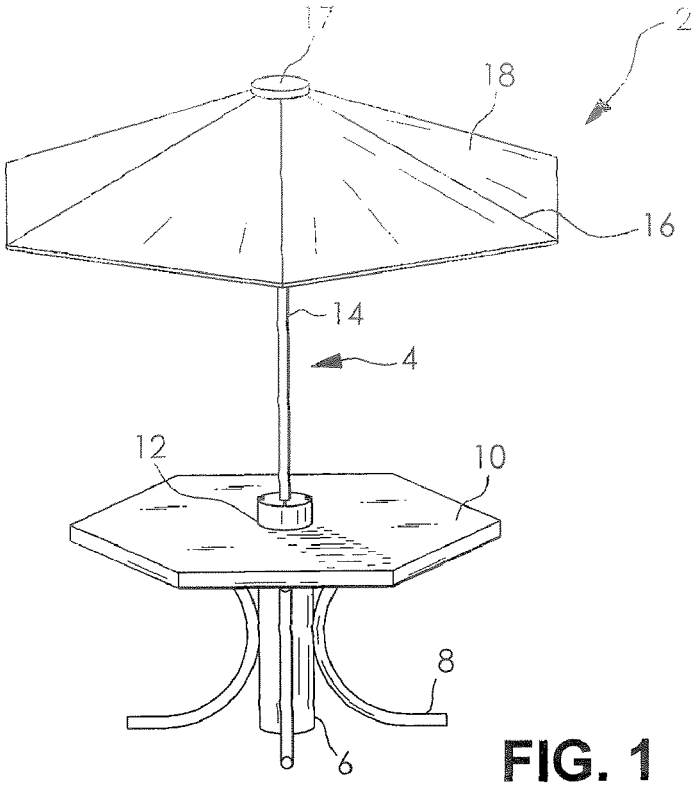
FIG. 1 is a top perspective view of a patio table according to the present disclosure.

The following description is merely exemplary in nature and is not intended to limit the present disclosure, application, or uses. It should also be understood that throughout the drawings, corresponding reference numerals indicate like or corresponding parts and features. In respect of the methods disclosed, the steps presented are exemplary in nature, and thus, are not necessary or critical.

As shown in FIGS. 1, 2A to 2C, and 3, the present disclosure includes a table 2 with a collapsible outdoor table umbrella 4. The table 2 has a hollow main body 6 configured to receive the umbrella 4 when in a collapsed or folded position. When the umbrella 4 is in the collapsed position, i.e., in a retracted and stowed position within the hollow main body 6, the umbrella 4 is fully concealed and stored safely against undesirable weather conditions. The umbrella 4 may subsequently be moved from the hollow main body 6 to an extended position to be opened and used.

The table 2 includes a plurality of ground engaging legs 8 coupled thereto and intermediate which the hollow main body 6 is disposed. The legs 8 at least partially support the table 2. In another embodiment, the table 2 may be supported by a weighted base (not shown). The weighted base may be integrally formed with the hollow main body 6, for example, to at least partially support the table 2. It should be appreciated that other means may also be employed to the support the table 2, as desired.

The hollow main body 6 may be formed from any durable material suitable to withstand prolonged weathering and outdoor exposure. For example, the hollow main body 6 may be formed from one of a metal, a plastic, and a composite material. In a particularly illustrative embodiment, the hollow main body is formed from an aluminum material. Other suitable materials may also be selected.

The table 2 of the present disclosure has a substantially planar surface 10 with an aperture 12 formed therein. The hollow main body 6 is disposed in the aperture 12. In one embodiment, the hollow main body 6 is a hollow cylinder extending through the aperture 12 having a substantially circular shape, and the surface 10 of the table 2 has a substantially hexagonal-shaped 10. The hollow main body 6 may alternatively be disposed flush with the surface 10 of the table 2 or directly underneath the surface 10 of the table 2. In another embodiment, the hollow main body 6 and the table 2 may be integrally formed. A skilled artisan should appreciate that other shapes of the substantially planar surface 10, the hollow main body 6, and the aperture 12 are also within the scope of the present disclosure.

Figure 3:
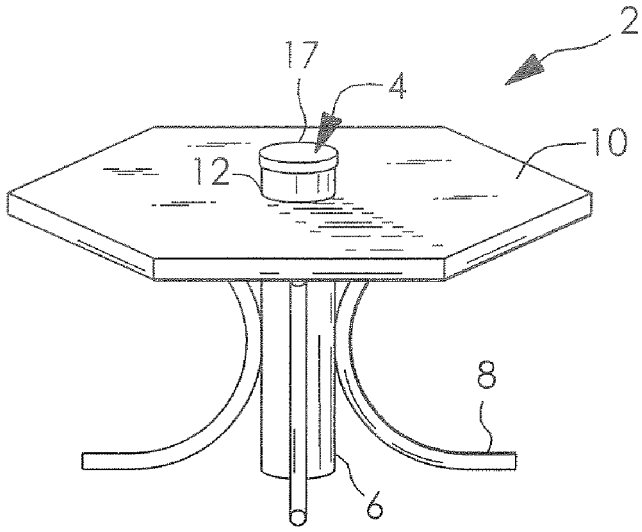
FIG. 3 is a top perspective view of the patio table illustrated in FIG. 1, with the umbrella stowed.

The umbrella 4 of the table 2 includes a pole 14 coupled to a plurality of hinged ribs 16. The pole may be hollow or solid, as desired. As shown in FIG. 3, the pole 14 includes a cap 17 affixed to an end thereof, and configured to rest adjacent and cover an open end of the hollow main body 6 when the umbrella 4 is stowed. The cap 17 may have a circumferential lip that slides over the outer surface of the hollow rain body 6, for example. The cap 17 may also have a handle (not shown) that facilitates a manual lifting of the umbrella 4 from the stowed position in the hollow main body 6.

Figure 2A:
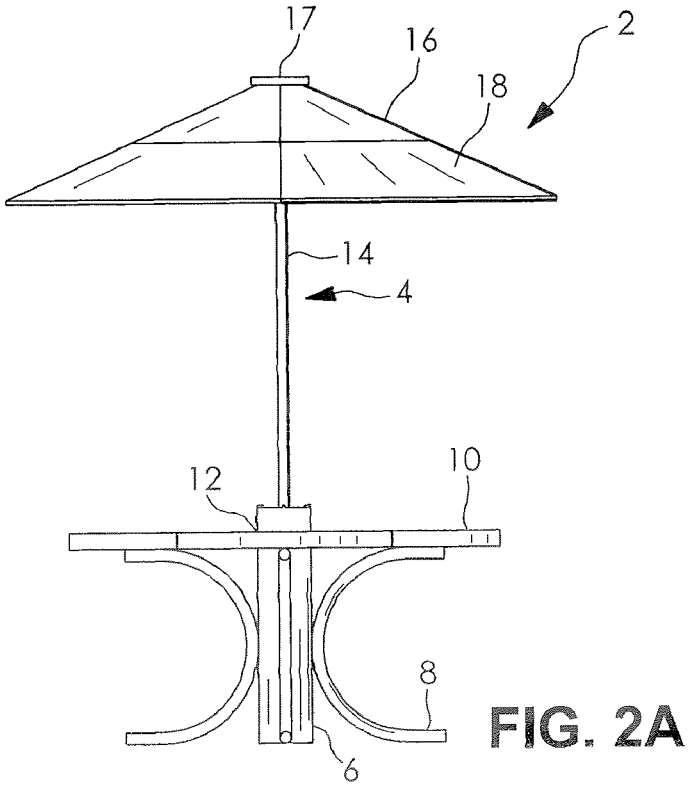
FIG. 2A is a front elevational view of the patio table illustrated in FIG. 1, showing an umbrella in a fully opened position.
Figure 2B:
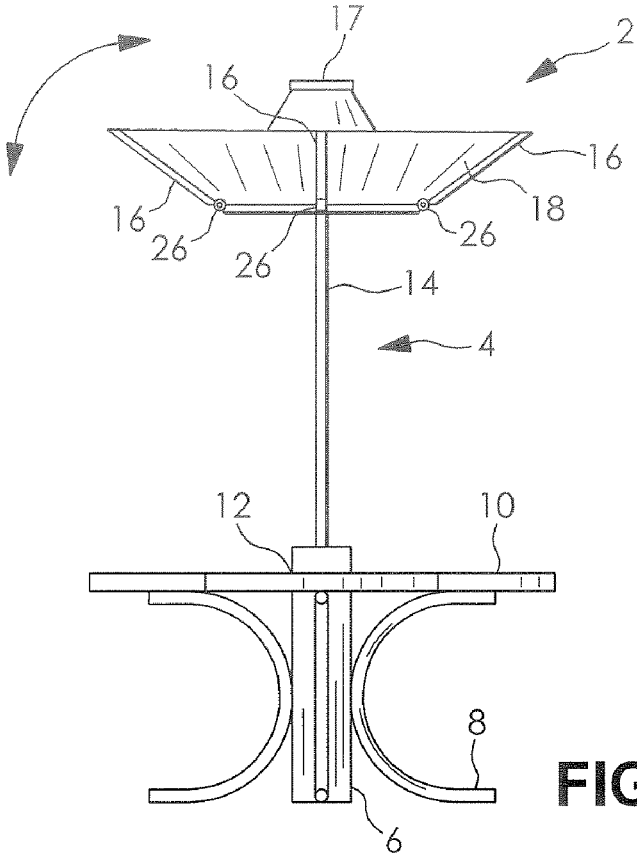
FIG. 2B is a front elevational view of the patio table illustrated in FIG. 1, showing the umbrella in a partially collapsed position.
Figure 2C:
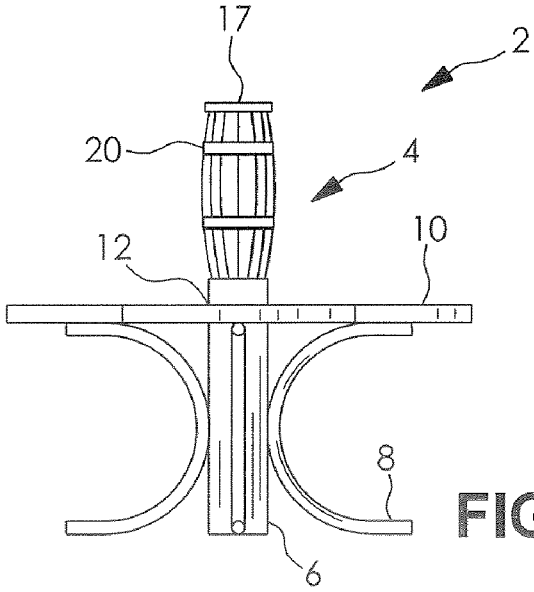
FIG. 2C is a front elevational view of the patio table illustrated in FIG. 1, showing the umbrella in a fully collapsed and secured position.

With renewed references to FIGS. 2A to 2C, the hinged ribs 16 support a canopy 18 that is configured to shade the table 2 when the umbrella 4 is in a fully extended and open position (shown in FIG. 2A). The canopy 18 may have at least one strap 20 attached thereto configured to secure the umbrella 4 in the collapsed position (shown in FIG. 2C), for example, by tying the strap 20 around the umbrella 4 prior to the umbrella being received by the hollow main body 6. The strap 20 may be disposed on an underside of the canopy 18 and facilitate an upward folding and securing of a portion of the hinged ribs 16 (shown in FIG. 2B). The strap 20 may further have fasteners, such as a hook and loop fasteners, snaps, buttons, and the like to secure the umbrella 4. In other embodiments, the strap 20 may be provided separately, such as an elastic or rubber band, and disposed over the umbrella 4 after the umbrella 4 has been fully collapsed for storage.

Figure 5:
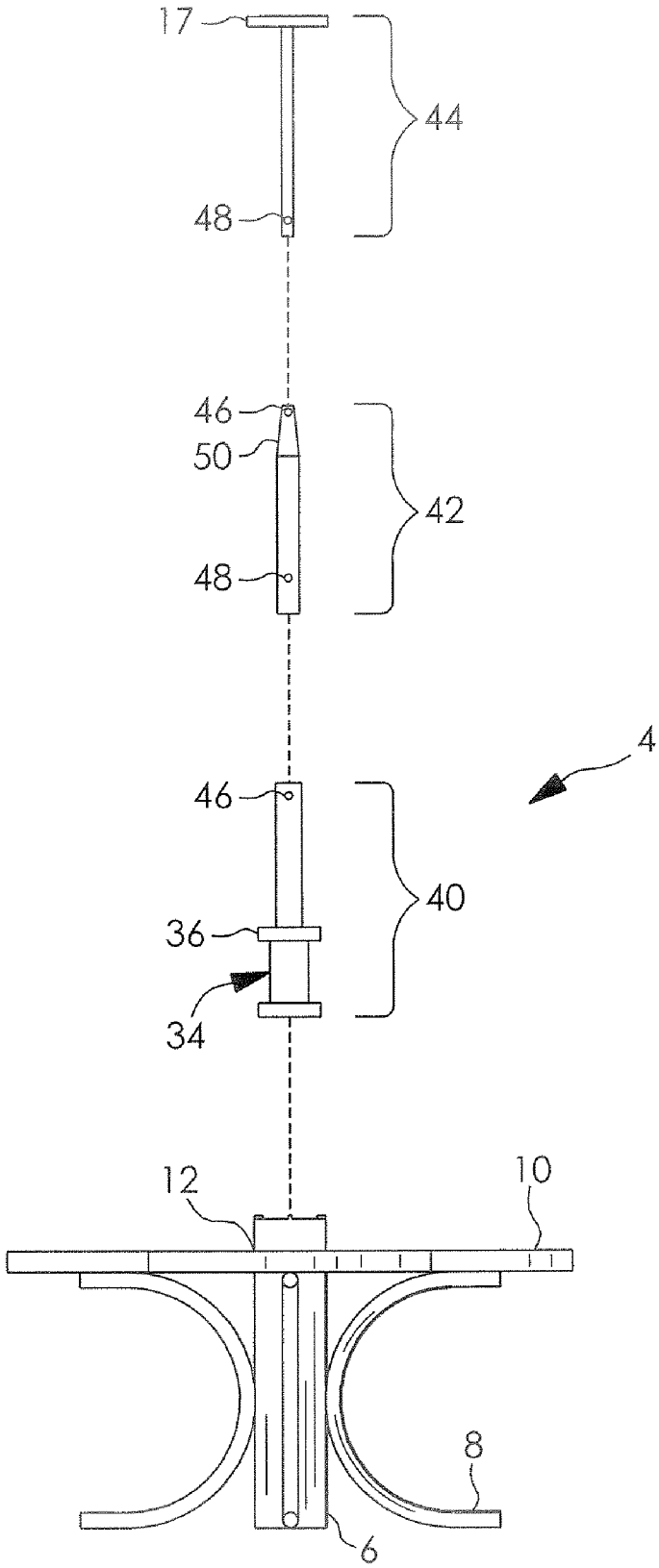
FIG. 5 is an exploded side elevational view of the patio table illustrated in FIG. 1, according to an embodiment of the present disclosure.

Referring now to FIG. 5, each of the hinged ribs 16 includes a first hinge 22. The first hinge 22 is disposed at a first end 24 of the rib 16 and facilitates a downward folding of the umbrella 4. The first hinge 22 may be disposed on an underside of the cap 17, for example. The ribs 16 pivot at the first hinges 22 to open and close the umbrella 4. Each of the hinged ribs 16 further include a second hinge 26 disposed between the first end 24 and a second end 28 of the rib 16. The second hinge 26 facilitates the upward folding of the portion of the ribs 16 of the umbrella 4. One of ordinary skill in the art should appreciate that the downward folding of the ribs 16 at first hinges 22 and the upward folding of the portion of the ribs 16 at the second hinges 26 may thereby result in a desirably compact configuration of the umbrella 4 in the collapsed position. The compact configuration may be one that is readily received by the hollow main body 6 of the table 2. The compact configuration also facilitates a concealment and storage of the entire umbrella 4 within the hollow main body 6 of the table 2.

As further shown in FIG. 5, the umbrella 4 includes a plurality of arms 30 that evenly guide the ribs 16 of the umbrella 4 as the umbrella 4 is opened and closed. The arms 30 are hingedly coupled to the ribs 16 and slidably coupled to the pole 14. As a nonlimiting example, each of the arms 30 may be hingedly coupled to each of the ribs 16 at the second hinge 26. The arms 30 may be hingedly coupled to each of the ribs 16 at other locations on the ribs 16, as desired. The arms 30 are also coupled to a bushing 32 slidably disposed on the pole 14. Other means for evenly guiding the ribs 16 during the opening and the closing of the umbrella 4 may also be employed, as desired.

Figure 6:
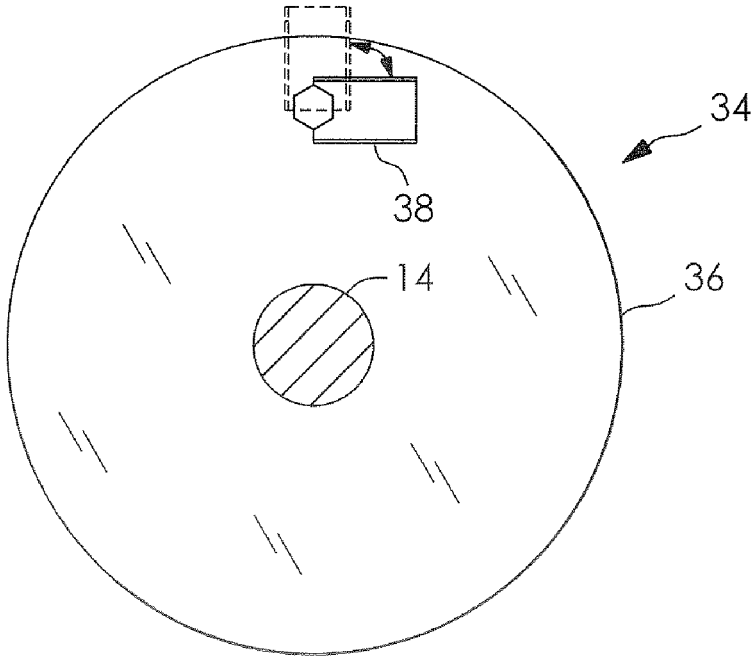
FIG. 6 is a top plan view of a plunger illustrated in FIG. 5 and showing a cap retainer in a retaining position and a non-retaining position, the retaining position shown in dashed lines.
Figure 4:
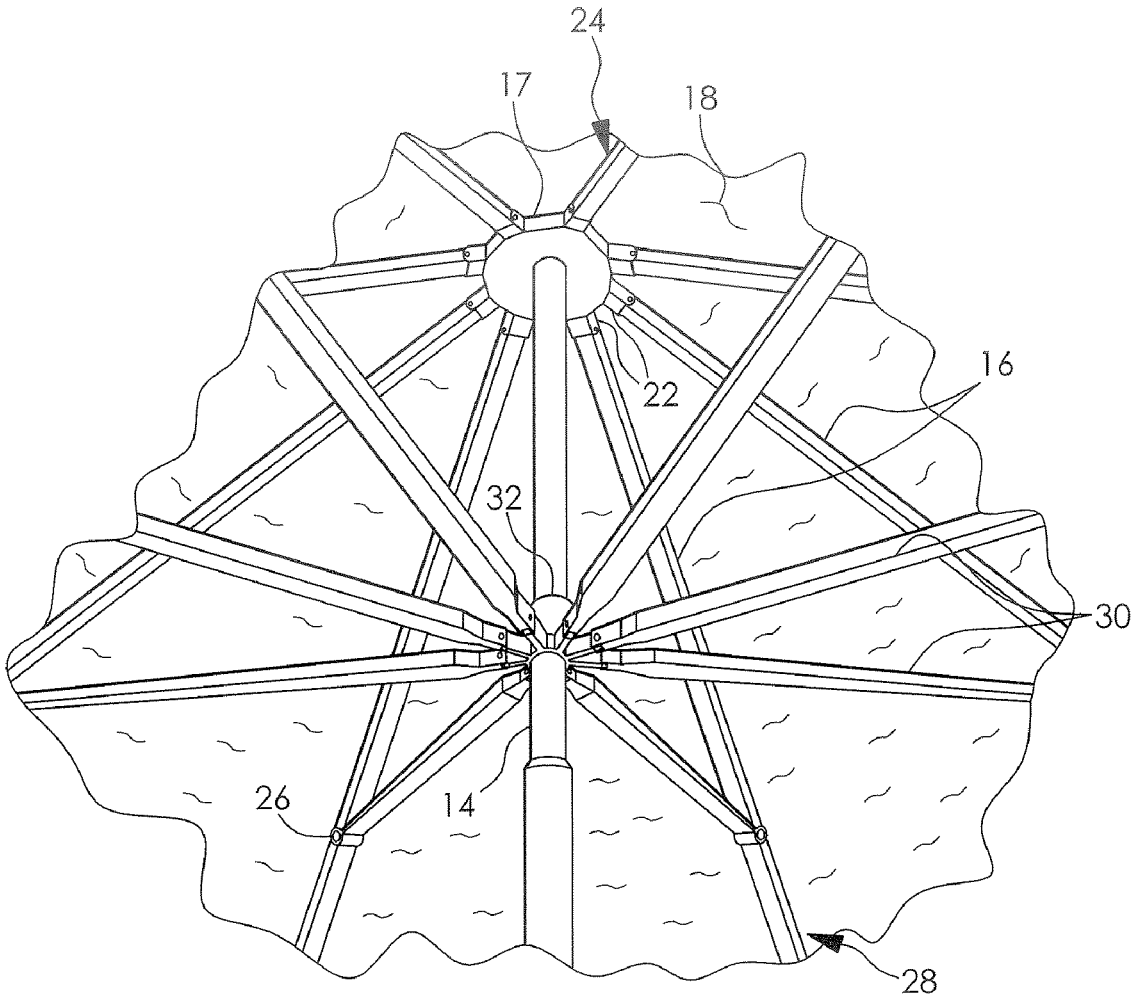
FIG. 4 is a fragmentary bottom perspective view of the umbrella of the patio table illustrated in FIG. 1, showing a plurality of first hinges and a plurality of second hinges that facilitate a folding of the umbrella.

In the embodiment shown in FIGS. 5 and 6, the pole 14 of the collapsible umbrella 4 is coupled to a plunger 34. The plunger 34 is adapted to be received in the hollow main body 6. For example, the plunger 34 may have an outer diameter that closely and slidably conforms to the inner diameter of the hollow main body 6. The pole 14 may thereby be rigidly held in an upright position when the plunger 34 is disposed inside of the hollow main body 6. In a particularly illustrative embodiment, the plunger 34 is formed from a pair of spaced apart disks 36. The plunger 34 is weighted so as to pull the umbrella 4 in the collapsed position into the hollow main body 6 for storage. The weight of the plunger 34 is selected so that the umbrella 4 may be manually removed from the hollow main body 6 for use. The plunger 34 may also be biased, for example, with a spring (not shown) disposed in the base of the hollow main body 6 to facilitate the manual removal of the umbrella 4 from the hollow main body 6. It should be further understood that a motor (not shown), such as one of an electric, hydraulic, and pneumatic motor, may be disposed in the hollow main body 6 to selectively move the umbrella 4, as desired.

The material from which the plunger 34 is formed may be any material that facilitates a sliding of the plunger 34 within the hollow main body 6, such as a plastic or rubber, for example. Other suitable materials may also be employed. The interior of the hollow main body 6 may also be lubricated to facilitate the sliding of the plunger 34 therein.

As shown in FIG. 6, the plunger 34 may have at least one retainer 38. The retainer 38 is configured to selectively hold the plunger 34, and thereby the umbrella 4, in the extended position. For example, the retainer 38 may be selectively rotatable to a position that disposes a portion of the retainer 38 adjacent an edge of the open end of the hollow main body 6. The retainer 38 thereby militates against a dropping of the plunger 34 into the hollow main body 6 and holds the umbrella 4 in the extended position. A skilled artisan should appreciate that other suitable means for retaining the umbrella 4 in the extended position may also be used.

With renewed reference to FIG. 5, the pole 14 may be a telescoping type which includes a bottom section 40, a middle section 42, and a top section 44. The bottom section 40 is affixed to the plunger 34 and the top section 44 is affixed to the cap 17. The bottom, middle, and top sections 40, 42, 44 may be configured to cooperate with one another to selectively collapse or extend the umbrella 4. The bottom, middle, and top sections 40, 42, 44 may have push button holes 46 and push buttons 48 that allow one to selectively move and hold the bottom, middle, and top sections 40, 42, 44 relative to one another, for example. The push buttons 48 may be spring-biased. As a nonlimiting example, the bottom section 40 may be hollow and configured to slidably receive the middle section 42. The bottom section 40 may have the push button hole 46 and the middle section 42 may have the push button 48 configured to cooperate with the push button hole 46 in the bottom section 40. Similarly, the middle section 42 may have the push button hole 46 and the top section 44 may have the push button 48 configured to cooperate with the push button hole 46 in the middle section 42. A skilled artisan may select the placement of the push button holes 46 and the push buttons 48 in each of the bottom, middle, and top sections 40, 42, 44 of the pole 14 as desired. Each of the bottom, middle, and top sections 40, 42, 44 may have beveled ends 50 that facilitate the sliding cooperation of one of the bottom, middle, and top sections 40, 42, 44 within another of the bottom middle, and top sections 40, 42, 44.

The present disclosure further includes a method for storing the collapsible umbrella 4 of the table 2. The method includes the steps of: providing the table 2 having the collapsible umbrella 4 and the hollow main body 6 adapted to receive the umbrella 4 when the umbrella 4 is in a collapsed position folding the umbrella 4 into the collapsed position; and disposing the umbrella 4 within the hollow main body 6. The collapsible umbrella 4 may thereby be easily and readily stored in case of undesirable weather and the like.

While certain representative embodiments and details have been shown for purposes of illustrating the invention, it will be apparent to those skilled in the art that various changes may be made without departing from the scope of the disclosure, which is further described in the following appended claims.

What is claimed is:

1. A table having a substantially planar surface with an aperture formed therein, the table comprising:

a collapsible umbrella including a pole coupled to a plurality of ribs supporting a canopy and a plurality of arms coupled to the ribs, wherein a first end of each of the ribs is pivotally coupled to the pole by a first hinge to facilitate a downward folding of the umbrella into a collapsed position, and each of the ribs is hinged intermediate the first end and a second end thereof by a second hinge to facilitate an upward folding of at least a portion of the umbrella, and wherein a first end of each of the arms is pivotally coupled to a corresponding one of the ribs by the second hinge and a second end of each of the arms is pivotally coupled to a bushing slidably received on the pole to facilitate an upward folding of the arms when the umbrella is positioned into the collapsed position; and a hollow main body adapted to receive the entire umbrella when the umbrella is in the collapsed position, the hollow main body disposed in the aperture formed in the table, wherein a portion of the hollow main body is disposed above the substantially planer surface, and wherein the pole is coupled to a plunger adapted to be received by the hollow main body, the plunger having an outer diameter substantially conforming to an interior shape of the hollow main body to militate against relative lateral movement therebetween.

2. The table of claim 1, further comprising a plurality of legs supporting the table, the hollow main body disposed intermediate the legs.

3. The table of claim 1, wherein the plunger includes a pair of spaced apart disks.

4. The table of claim 1, wherein the plunger has at least one retainer configured to selectively hold the plunger when the umbrella is in an extended position.

5. The table of claim 4, wherein the at least one retainer is selectively rotatable to a position that disposes a portion of the retainer adjacent the hollow main body.

6. The table of claim 1, wherein the pole is a telescope type having a bottom section, a middle section, and a top section, the bottom section affixed to the plunger and slidably coupled with the middle section, and the middle section selectively coupled with the top section.

7. The table of claim 6, wherein the top section is affixed to a cap configured to rest adjacent the hollow main body when the umbrella is received by the hollow main body.

8. The table of claim 6, wherein the bottom section has a push button hole formed therein and the middle section has a spring-biased push button, the push button configured to cooperate with the push button hole to selectively lock the middle section in an extended position.

9. The table of claim 6, wherein the middle section has a push button hole formed therein and the top section has a push button hole, the push button configured to cooperate with the push button hole to selectively couple the middle section to the top section.

10. The table of claim 6, wherein the middle section has a beveled end to facilitate the selectively coupling of the middle section with the top section.

11. The table of claim 1, wherein a lower portion of each of the ribs is pivotally coupled to an upper portion of each of the ribs by the second hinge to facilitate an upward folding of the lower portion of the ribs and at least a portion of the canopy.

12. The table of claim 11, wherein the second hinge includes a first terminal end of the lower portion of the rib, a second terminal end of the upper portion of the rib, and a common pivot to pivotally couple the first terminal end of the lower portion of the rib to the second terminal end of the upper portion of the rib.

13. The table of claim 12, wherein a face of the first terminal end of the lower portion of the rib abuts a face of the second terminal end of the upper portion of the rib when the umbrella is in an open position.

14. The table of claim 12, wherein the second hinge further includes the first end of each of the arms.

15. A method for storing a collapsible umbrella of a table, comprising the steps of:

providing the table having the collapsible umbrella and a hollow main body adapted to receive the entire umbrella when the umbrella is in a collapsed position, wherein a portion of the hollow main body is disposed above a substantially planar surface of the table, wherein the collapsible umbrella includes a pole coupled to a plurality of ribs supporting a canopy and a plurality of arms coupled to the ribs, wherein a first end of each of the ribs is pivotally coupled to the pole by a first hinge to facilitate a downward folding of the umbrella into the collapsed position, and each of the ribs is hinged intermediate the first end and a second end thereof by a second hinge to facilitate an upward folding of at least a portion of the umbrella, and wherein a first end of each of the arms is pivotally coupled to a corresponding one of the ribs by the second hinge and a second end of each of the arms is pivotally coupled to a bushing slidably received on the pole to facilitate an upward folding of the arms when the umbrella is positioned into the collapsed position;

folding the umbrella into the collapsed position, and stowing the entire umbrella within the hollow main body.

16. The method of claim 15, wherein a lower portion of each of the ribs is pivotally coupled to an upper portion of each of the ribs by the second hinge to facilitate an upward folding of the lower portion of the ribs and at least a portion of the canopy.

17. The method of claim 16, wherein the second hinge includes a first terminal end of the lower portion of the rib, a second terminal end of the upper portion of the rib, and a common pivot to pivotally couple the first terminal end of the lower portion of the rib to the second terminal end of the upper portion of the rib.

18. The method of claim 17, wherein a face of the first terminal end of the lower portion of the rib abuts a face of the second terminal end of the upper portion of the rib when the umbrella is in an open position.

19. The method of claim 17, wherein the second hinge, further includes the first end of each of the arms.

* * * * *